United States Patent [19]
Winberg
[11] 4,270,348
[45] Jun. 2, 1981

[54] MATERIALS AND METHOD FOR PREVENTING HIGH TEMPERATURE SEIZE BETWEEN METAL PARTS

[75] Inventor: Robert F. Winberg, Burton, Mich.

[73] Assignee: General Motors Corporation, Detroit, Mich.

[21] Appl. No.: 59,644

[22] Filed: Jul. 23, 1979

[51] Int. Cl.[3] ..... F01M 7/10; C10M 1/10; C10M 3/02; C10M 5/02

[52] U.S. Cl. ..... 60/323; 252/26; 252/28; 427/388.1

[58] Field of Search ..... 252/28, 26; 123/196 R; 148/6.3, 31.5, 6.35; 308/DIG. 8; 428/629, 632, 633; 60/323; 427/388.1

[56] References Cited

U.S. PATENT DOCUMENTS

| | | | |
|---|---|---|---|
| 2,445,901 | 7/1948 | Ambrose et al. | 252/28 X |
| 3,110,669 | 11/1963 | Borg | 252/28 |
| 3,180,828 | 4/1965 | Slater | 252/28 |
| 3,242,076 | 3/1966 | Hagan | 252/26 |
| 3,254,401 | 6/1966 | Dalton et al. | 252/28 X |
| 3,411,564 | 11/1968 | Miller | 252/28 X |
| 3,496,030 | 2/1970 | Powers | 148/6.3 |
| 3,549,531 | 12/1970 | Santt | 252/26 |
| 3,677,803 | 7/1972 | Bennett et al. | 252/28 X |
| 3,840,461 | 10/1974 | Espunes | 252/28 X |

*Primary Examiner*—Michael R. Lusignan
*Attorney, Agent, or Firm*—E. F. Harasek

[57] ABSTRACT

Seize is prevented between metal surfaces exposed to high temperature and corrosive gases by an antiseize coating layer. The coating comprises per 100 weight parts, about 10–30 parts chemically inert anti-seize particles that have a fusion point above about 100° C. and are in the size range of from about 2–100 microns; about 5–25 parts of a polymeric binder resin that is adherent to metal surfaces; and the balance, a volatile solvent for the resin. The liquid coating is applied by suitable means, and dried by evaporating the solvent. At least a layer of the particles remains dispersed in the dried resin and provides the coating with its antiseize properties.

4 Claims, 1 Drawing Figure

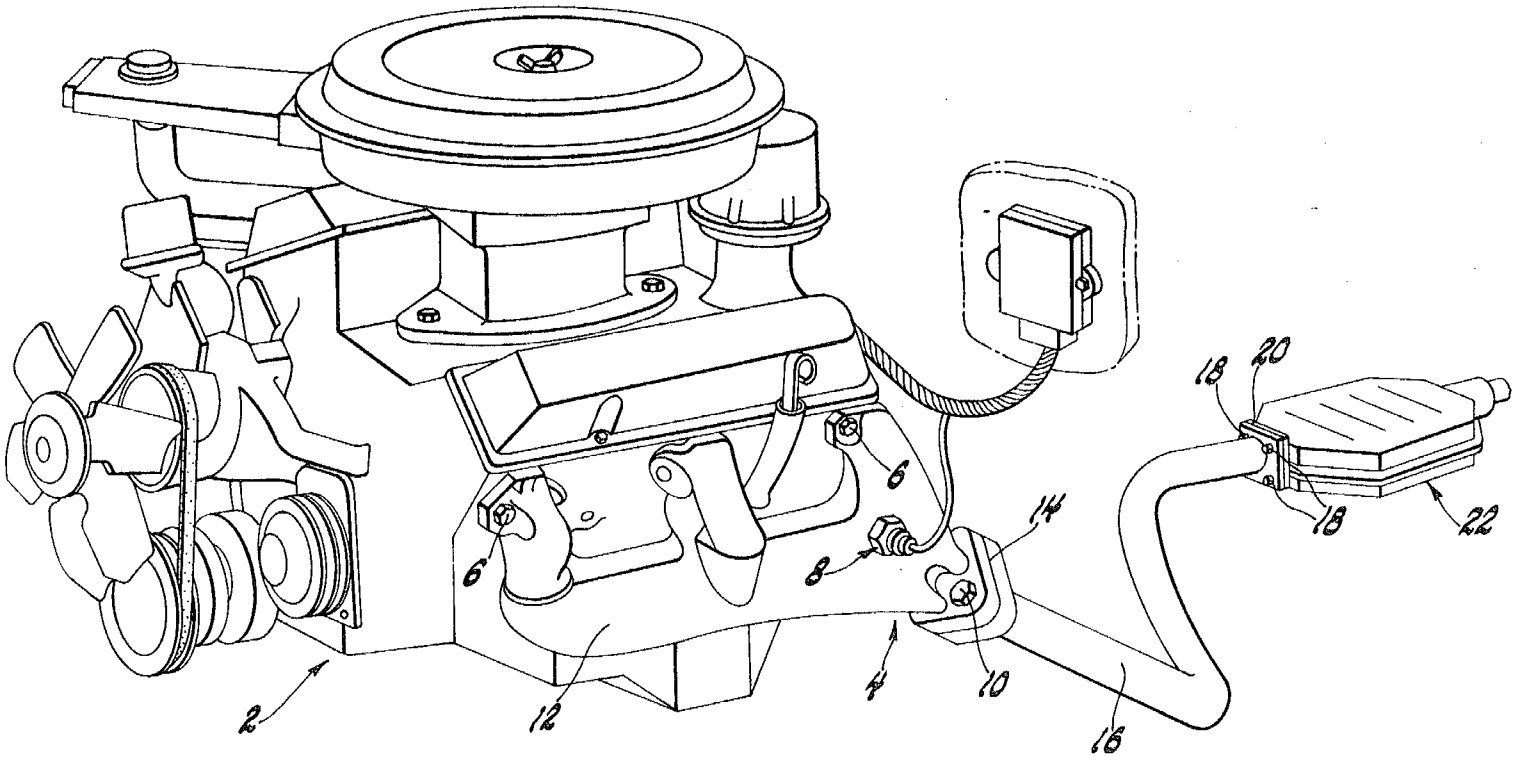
22
18
20
18
16
14
10
4
6
8
12
6
2

MATERIALS AND METHOD FOR PREVENTING HIGH TEMPERATURE SEIZE BETWEEN METAL PARTS

BACKGROUND OF THE INVENTION

This invention relates to a method and materials to prevent bonding between metal parts exposed to corrosive gases at high temperatures. More particularly, the invention relates to interposing at least one layer of high melting, nonmetallic, micron sized particles between the mating surfaces of internal combustion engine or exhaust system components to prevent seize between them.

High temperatures and corrosive atmospheres are encountered by automotive internal combustion power plants and their exhaust trains. By the power plant is meant the engine block and power generating piston assemblies. By exhaust train is meant the engine manifold and the conduit components downstream thereof to the tailpipe. Components such as manifold oxygen exhaust sensors, catalytic converters, resonators and mufflers may reach temperatures as high as 1,000° C. during engine operations. At such temperatures, adjacent metals tend to weld or sinter together. Moreover, gases such as water, sulfur oxides, and nitrogen oxides are formed by the combustion of air and petroleum based hydrocarbon fuels. The interaction of these hot gases with each other and metal surfaces may cause corrosion bonding. Herein, the tendency of adjacent metal surfaces to bond together by the combined effects of high temperature and a corrosive atmosphere is referred to as "seize." This invention relates to preventing seize between metal parts in general and automotive parts in particular. When seize occurs between parts in the engine or exhaust train of an automobile, it becomes difficult or impossible to separate them for repair or replacement. Attempts have been made to prevent seize between parts by coating them with a relatively inert metal such as silver. However, this method is expensive and unreliable at temperatures above about 800° C. Another approach has been to coat parts with a mixture of high viscocity petroleum grease and aluminum, silver, or copper flake powder. However, this method is also expensive, and the parts once coated are messy and hard to handle. Moreover, the grease may be adversely affected at temperatures over 800° C.

OBJECTS OF THE INVENTION

It is therefore an object of this invention to provide reliable and relatively inexpensive materials and methods for preventing seize between metal parts exposed to high temperatures and corrosive atmospheres. It is a more particular object to prevent seize between automotive components, particularly in the power plant and exhaust train. It is a more specific object to interpose at least a layer of micron-sized nonmetallic particles between adjacent metal parts to prevent seize at elevated temperatures in corrosive atmospheres.

It is a more particular object to provide an antiseize material that will not sinter to itself or metal substrates at temperatures up to about 1,000° C., nor combine with exhaust gases at such temperatures to form products which adhere to metal. It is another object to provide the antiseize material in the form of relatively inert, high melting, micron-sized particles dispersed in a mixture of a polymeric binder resin and a solvent for the resin. A more specific object is to provide such dispersions with a small proportion of expendable solid lubricating particles to initially facilitate joining closely fitting metal parts without disturbing the antiseize coating.

Another object is to coat the mating surfaces of adjacent metal parts with a dispersion of antiseize particles and a polymeric resin prior to exposure to high temperatures and corrosive gases. A more specific object is to provide an antiseize coating in a convenient form so that it can be applied to a metal surface by spraying or brushing and dried to form a scuff resistant, permanent antiseize coating layer.

BRIEF SUMMARY OF THE INVENTION

The invention is a method of preventing seize between contiguous metal parts exposed to high temperatures and materials used in the method. In a preferred embodiment, an antiseize coating is made up of a natural or synthetic resinous polymeric binder material dissolved in a volatile liquid solvent. The solution is air dryable to an adherent, non-tacky coating at room or elevated temperatures. Antiseize particles having an average size in the range of from about 2 to 100, preferably 5 to 25 microns, are dispersed in the solution. The particles are non-metallic and have a melting point above about 1,000° C. They are chosen so that they do not sinter together or to metal surfaces at temperatures lower than about 1,000° C., and are substantially inert to automotive exhaust gases at such temperatures. Two preferred antiseize materials are glass spheres having melting and sintering points above 1,000° C., and cupric oxide particles.

In the method at least one mating surface of adjacent metal parts is coated, preferably by brush or spray, with the above-described dispersion. The solvent is evaporated, leaving at least one layer of the antiseize particles dispersed in the dried resin on the metal surface. Optionally, a small percentage of micron-sized particles of a solid lubricant such as graphite may also be dispersed in the resin-solvent-particle mixture. The solid lubricant reduces the coefficient of friction of the coating surface so that close tolerance parts, such as a threaded nut and bolt can be joined together without disturbing the layer or layers of antiseize particles.

When a coated part is exposed to temperatures above a few hundred degrees, the carrier resin and solid lubricant are destroyed. However, the antiseize particles are not adversely affected, even when the coated parts see temperatures of up to 1,000° C. and are exposed to corrosive gases, such as automotive exhaust, for prolonged periods of time. The interposition of the inert particles between metal surfaces separates them from one another and prevents seize. With the application of a moderate mechanical force by, e.g., a hand-held wrench, the particles of the antiseize coating are dislodged and act as "ball-bearing" type lubricants so the adjacent parts can readily be separated.

Thus, automotive engine and exhaust system component parts, coated in accordance with my invention, will not seize and can be separated from each other by ordinary means even after long service. The subject coating also provides such parts with corrosion resistance.

DETAILED DESCRIPTION OF THE INVENTION

My invention will be more clearly understood in view of the following detailed description and examples.

The FIGURE depicts an elevational side view of an internal combustion engine, with exhaust manifold oxygen sensor, and catalytic converter.

In accordance with this invention, metal parts are coated with the subject antiseize compositions prior to assembly. Even after extended operation at high temperatures in the presence of corrosive exhaust gases, the coating prevents seize between adjacent parts so that they can be easily separated.

In a preferred embodiment, an antiseize coating was formed by combining in weight parts, 70 parts isopropyl alcohol and 7 parts of a polymeric binder resin soluble therein. Twenty parts glass beads, having a size in the 5 to 15 micron range and a fusion point of about 1025° C. were added. The glass particles are the antiseize agent in the composition. Three parts graphite particles, 10 micron maximum size, were dispersed in the mixture. The graphite particles serve as a solid lubricating agent for the coating during part installation. The coating composition may be made up in large batches and stored in sealed containers for later use. Agitation may be required before use to redisperse the antiseize particles, lubricating particles, and binder resin in the solvent.

By polymeric binder resin herein is meant a natural or synthetic polymeric material that will adhere to clean metal and that is soluble in a liquid medium that evaporates at room or elevated temperatures in a reasonable period of time. For a list of suitable resins and solvents see, for example, the Kirk-Othmer Encyclopedia of Chemical Technology, Third Edition (1979), Volume 6, pages 427–430. It is preferred to have a resin content of about 5 to 10 weight percent of the total antiseize mixture or an amount of resin sufficient to deposit a layer at least about 1,000 microns thick on a vertically oriented metal substrate without substantial sagging or dripping. The resin solvent preferably has a low vaporization temperature so that the coating dries rapidly at room or elevated temperatures, and a low toxicity. The choice of binder resin and solvent is not critical to the practice of the invention although the resin should adhere strongly enough to a metal substrate that it will not be disturbed by the rapid removal of a piece of pressure sensitive adhesive tape applied to the dried coating. The polymeric material is used simply to adhere the antiseize particles to the substrate. Once a part is installed, the heat experienced during engine operation and exposure to corrosive gases destroys the binder resin. Briefly, the FIGURE shows portions of an engine and exhaust train for an automotive vehicle such as a passenger automobile or a truck. Certain component parts thereof see high temperatures during normal operation. Under these conditions adjacent metal surfaces tend to seize so parts cannot later be separated from one another without damage. Some of the parts that get very hot and are particularly susceptible to seize are numbered on the accompanying FIGURE as will be described hereafter.

With reference to the FIGURE, our invention finds application in preventing seize between metal parts, particularly in the engine 2 and exhaust train 4 of an automotive vehicle. The liquid antiseize composition described above was brushed onto the thread portions of manifold bolts 6 and dried in air at 50° C. for about 10 minutes. The resulting layer was about 1,000 microns thick and consisted of a layer of resin in which a plurality of layers of the glass and graphite particles were dispersed. Screws 6 were made of cold rolled steel and exhaust manifold 12 of cast iron. Similarly, the stainless steel thread portions of oxygen sensor 8 were coated and dried. The composition was also applied to coupling bolts 10 and linkage 14 between manifold 12 and exhaust pipe 16 and to bolts 18 and linkages 20 at either end of catalytic converter container 22. Engine 2 was operated at full horsepower for 200 hours. In a similar test where the oxygen sensor was not coated with the antiseize material, the threads were stripped both in the manifold and on the sensor when removal was attempted. With the subject antiseize coating, sensor 8 was easily removed from manifold 12 and no damage was suffered by the threads of either. Similarly, manifold linkage 14 and linkage bolts 10 were easily removed with hand wrenches. The catalytic converter coupling bolts 18 and linkages 20 were also easily disassembled. We believe that these antiseize characteristics are provided by the interposed layers of glass particles between the adjacent metal parts. Although the resin and graphite particles of the mixtures were destroyed by the engine operation, the glass particles remained interposed in a discrete layer and functioned as miniature ball bearings to facilitate removal of the part.

Further tests were conducted on a linear 4 cylinder gasoline engine driven by a dynamometer. The oxygen sensor base portion was made of type 416 martensitic stainless steel and was coated with the composition described above. The cast iron manifold and sensor were exposed to 200 thermal cycles between temperatures of 275° and 850° C. The torque-in force on the sensor shell was 13–17 foot pounds. The torque-in force to attain the same clamp load between manifold and engine block without the coating was 35 foot pounds. After the 200 thermal cycles, an oxygen sensor could be easily removed without damage to the sensor threads or to the bore threads in the manifold. The experiment was repeated substituting micron size particles of cupric oxide, melting point 1064° C., for the glass beads. The cupric oxide provided substantially the same antiseize characteristics. Generally, the subject coatings provide sufficient antiseize action to guarantee that the torque necessary to remove a threaded part will be no greater than 1.25 times the torque required to put it in. In most cases, the torque-out of coated parts was no more than 1.1 times the torque-in.

The subject high temperature antiseize coatings were also found to provide corrosion resistance to iron based substrates. The glass bead containing coating described above was applied to six ½-20,2.25 inch hexagonal head machine bolts. The bolts were formed of alloyed high speed steel with an M-6 ASM designation. An assembly was formed with each bolt consisting of a hardened steel washer, a cold rolled steel bushing about one inch long and another hardened steel washer. The assembly of washer and bushing was torqued against the bolt head by means of a ½-20 hexagonal nut of M-6 steel. The nut was tightened down to the clamp load of 16,000 pounds on the bushings and washers. A second group of bolts with washers, bushing, and nut was assembled without application of the antiseize coating. Both groups of fasteners were exposed to a five percent sodium chloride salt spray, nozzle pressure 10–25 psi, for 120 continuous hours at a temperature of 92°–97° F. The assemblies without the coating were badly encrusted with a layer of rust after salt spray exposure, while those with the protective antiseize coating showed no rust. Although our invention is not limited by the chemical mechanism involved in preventing rust, it is our belief that the interposition of layers of electrically nonconductive glass beads or metal oxides between adjacent metal surfaces prevents any galvanic action therebetween, depriving the surfaces of pathways for rust initiation. The nuts were removed from the coated and uncoated bolts after testing. Table I sets forth data recorded for the experiment.

TABLE I

| | Corrosion Tests* | |
|---|---|---|
| | Antizeize Coated | Not Coated |
| | N.M | N.M |
| Installation Torque (16000 lbs) | 130 | 191 |
| Installation Torque Range to Clamp Load | 11 | 57 |
| Removal Torque After Salt Spray | 107 | 159 |

*reported numbers are averages for 6 coated and 6 uncoated bolt assemblies.

It can be seen from the Table that use of the subject coating material provides lower installation torques for equal clamp loads, 130 Newton-meters for the coated bolts compared to 191 Newton-meters for the uncoated bolts. Moreover, the range of torque installations was much lower for the coated bolts, 11 Newton-meters, than for the uncoated bolts, 57 Newton-meters. The overall torques required to remove the nuts from the bolts was much lower for the antiseize coated bolts, 107 Newton-meters as opposed to 159 Newton-meters for the uncoated bolts. The salt spray test is not as severe as exposure to exhaust gases in an automotive exhaust manifold. Exhaust emissions from hydrocarbon fuels include sulfur and nitrogen oxides which combine with available steam to form acidic products. The acid environment coupled with elevated temperature promotes rapid corrosion of ferrous materials. Even in this adverse environment, the antiseize coating prevents rust for prolonged periods. Thus, the improvement in torque-off values for coated parts in exhaust systems are even more dramatic than those reported for the salt spray tests. Without the coating, parts such as manifold bolts and catalytic converter and muffler coupling bolts will yield and break before reaching torque levels required to loosen them.

Particles useful as antiseize agents in accordance with the invention are those having fusion and/or melting points above temperatures that will be encountered in use. In automotive exhaust systems, generally such material should have melting points above 1,000° C. It is another requirement that the antiseize particles remain discrete from each other and the substrate at temperatures up to their melting points. Furthermore, the particles should not react with high temperature exhaust gases. We prefer to use high melting oxides of metals such as copper or aluminum, or semimetals such as silicon. The glass beads are combinations of silicon and aluminum oxides with traces of other metal oxides. The particles should be large enough to prevent surface contact between adjacent parts but not so large that they bind with or embed themselved in the substrate upon application of force. Generally, antiseize particles in the size range of 2-100 microns, preferably 5-25 microns, are suitable. The particles are equally effective whether their shapes are spherical, platelike, elongated or irregular. The amount of antiseize particles dispersed in the liquid resin carrier should be sufficient to deposit a coating at least one particle layer thick on the surface of the substrate whether it is applied by brushing, spraying or dipping. Generally about 20 weight parts antiseize particles per 80 parts solvent and resin is suitable.

Micron sized particles (preferably 1-100 microns) of lubricating solids such as graphite, zinc stearate, molybdenum sulfide may be incorporated in the coatings to facilitate part assembly. However, these materials are destroyed by extended exposure to high temperatures and/or corrosive atmospheres. Their presence helps prevent abrasion of the antiseize coating during assembly, but does not contribute to the high temperature antiseize capabilities of a coating.

While my invention has been described in terms of specific embodiments thereof, other forms may readily be adapted by one skilled in the art. Therefore, my invention may be limited only by the following claims.

The embodiments of the invention in which an exclusive property or privilege is claimed are defined as follows:

1. A method of preventing seize between closely engaged metal parts at elevated temperatures of up to about 1000° C., which parts are stationary with respect to one another, comprising interposing a layer of discrete particles between said parts wherein said particles are initially suspended adjacent a said part in a resinous polymeric binder medium, said particles being in the size range of from about 2 to 100 microns and comprising one or more members taken from the group consisting of glass, metal oxides and semimetal oxides having fusion points above about 1000° C., which particles do not adhere to one another or said metal parts at said elevated temperatures but which easily dislodge to facilitate part separation after extended exposure to said elevated temperatures which destroy said binder medium.

2. A method of preventing seize between closely engaged ferrous parts at elevated temperatures up to about 1000° C., particularly in the presence of acidic gases, which parts are stationary with respect to one another, the method comprising interposing a layer of discrete particles carried in a resinous polymeric binder medium and being in the size range of from about 2 to 100 microns between said ferrous parts, said particles comprising one or more members taken from the group consisting of glass having a fusion point of about 1000° C., copper oxide, silicon oxide, and aluminum oxide, which particles do not adhere to one another or said metal parts, but which easily dislodge to facilitate part separation after extended exposure to said elevated temperatures at which said binder medium is destroyed.

3. In an internal combustion powered automotive vehicle comprising an engine block, a manifold mechanically fastened thereto for collecting exhaust gases, and exhaust conduit components downstream of the manifold, it being desired to prevent seize between relatively stationary components after extended operation at elevated temperatures of up to about 1000° C., a method comprising interposing a layer of discrete particles between the mating surfaces of adjacent components, which particles are initially carried in a polymeric binder medium and are comprised of one or more members taken from the group consisting of glass having a fusion point above about 1000° C., copper oxide, aluminum oxide, and silicon oxide, and said particles being in the size range of about 2 to 100 microns, and said particles being substantially inert to exhaust gases at elevated temperatures below their fusion points but above the temperature at which the binder medium is destroyed such that the particles provide antiseize characteristics to said components after said extended operation.

4. A method of preventing seize between relatively stationary closely engaged ferrous parts exposed to elevated temperatures up to about 1000° C., particularly in the engine and exhaust train of an internal combustion engine powered automotive vehicle, the improvement wherein seize is prevented between said ferrous parts by interposing a layer of discrete antiseize particles between the parts which are easily dislodged when the parts are separated, said particles comprising one or more members taken from the group consisting of glass, cupric oxide, aluminum oxide and silicon oxide, said glass having a fusion point above about 1000° C., and said particles being in the size range of about 2 to 100 microns, said particles being suspended adjacent to said part by a resinous polymeric medium binder prior to exposure to said elevated temperature, wherein said particles do not adhere to one another or the ferrous parts after extended exposure to said elevated temperatures which temperatures destroy the resinous polymeric binder medium.

* * * * *